US010710263B1

(12) United States Patent
Flinner, Jr. et al.

(10) Patent No.: US 10,710,263 B1
(45) Date of Patent: Jul. 14, 2020

(54) CUTTING ROLL CARTRIDGE FOR MODULAR INSTALLATION IN A CUTTING ROLL ASSEMBLY

(71) Applicant: Akron Steel Fabricators Co., Akron, OH (US)

(72) Inventors: Victor Jay Flinner, Jr., Canton, OH (US); Kevin R. Kline, Akron, OH (US); Leon Poole, Uniontown, OH (US); Raymond John Popplewell, Ontario (CA); Jeffrey Monroe Sultzbaugh, Mogadore, OH (US); Timothy Alan Wilmoth, Akron, OH (US)

(73) Assignee: AKRON STEEL FABRICATORS CO., Akron, OH (US)

( * ) Notice: Subject to any disclaimer, the term of this patent is extended or adjusted under 35 U.S.C. 154(b) by 12 days.

(21) Appl. No.: 15/667,152

(22) Filed: Aug. 2, 2017

Related U.S. Application Data

(62) Division of application No. 14/317,270, filed on Jun. 27, 2014, now abandoned.

(60) Provisional application No. 61/840,000, filed on Jun. 27, 2013.

(51) Int. Cl.
*B26D 7/26* (2006.01)
*B26F 1/38* (2006.01)

(52) U.S. Cl.
CPC ..... *B26D 7/2614* (2013.01); *B26F 1/384* (2013.01)

(58) Field of Classification Search
CPC ..... B26D 7/2614; B26D 7/1836; B26F 1/384
USPC ..... 83/331–349
See application file for complete search history.

(56) References Cited

U.S. PATENT DOCUMENTS

| | | | | | |
|---|---|---|---|---|---|
| 2,803,100 | A * | 8/1957 | Aalseth | B29C 66/4322 | 53/510 |
| 3,448,684 | A * | 6/1969 | Cardinet | B21B 31/30 | 100/171 |
| 3,543,622 | A * | 12/1970 | Rice | G03D 15/046 | 83/117 |
| 5,590,557 | A * | 1/1997 | Keller | B21B 31/02 | 72/238 |
| 2003/0136240 | A1* | 7/2003 | Hesterman | B26D 5/20 | 83/152 |
| 2010/0101392 | A1* | 4/2010 | Zeuschner | B65B 61/10 | 83/171 |
| 2013/0019723 | A1* | 1/2013 | Nadrchal | B26D 1/40 | 83/13 |
| 2014/0061347 | A1* | 3/2014 | Chang | B02C 18/0007 | 241/282.1 |

* cited by examiner

*Primary Examiner* — Ghassem Alie
*Assistant Examiner* — Nhat Chieu Q Do
(74) *Attorney, Agent, or Firm* — Renner Kenner Greive Bobak Taylor & Weber

(57) ABSTRACT

A cutting roll assembly 10 for severing pieces from a length of material and advanced into proximity thereto includes a cutting roll cartridge 12 removably attached to an associated base 26 and frame 28. The cutting roll cartridge 12 includes a cutter roll 16 carrying at least one cutter blade 18 on its periphery and an anvil roll 14 used to cut material thereagainst as material is advanced between the rolls 16, 18. When the cutters 18 need repair, the cutting roll cartridge 12 is readily removable from the associated frame 28 and base 26 and replaceable by an identical cartridge to reduce downtime of the associated equipment.

2 Claims, 9 Drawing Sheets

CUTTING ROLL CARTRIDGE FOR MODULAR INSTALLATION IN A CUTTING ROLL ASSEMBLY

CROSS-REFERENCE TO RELATED APPLICATION

This application is a division of U.S. patent application Ser. No. 14/317,270 filed on Jun. 27, 2014, which claimed priority from U.S. Provisional Patent Application Ser. No. 61/840,000 filed Jun. 27, 2013, entitled A Modular Cutting Roll Assembly, the entire contents of both which are incorporated herein by reference.

TECHNICAL FIELD

The present invention relates, in general, to a cutting roll assembly for use with a loading conveyor in which lengths of material are advanced along the conveyor to a cutting point and then severed into predetermined lengths for eventual further processing. More particularly, this invention relates to a cutting roll assembly having a cutting roll cartridge where the cutting roll cartridge can be modularly installed within the cutting roll assembly.

BACKGROUND

It has long been known that rotary cutters can be utilized to sever substantially endless lengths of material into predetermined lengths for feeding into machines for further processing. These cutters generally involve the use of oppositely rotating rolls, one of which carries cutting blades and one of which serves as an anvil against which the material is cut by the blades. Such cutters are generally disclosed by U.S. Pat. No. 6,112,628 ('628 patent), which is incorporated herein by reference. While the cutters generally disclosed by the '628 patent are useful machines, the cutting blades thereof experience wear as a result of extended use. As the blades wear to a certain threshold, the equipment connected with the cutter assembly must be taken offline in order to repair or replace the blades. Such repair or replacement results in the associated equipment being offline for an extended period of time. When the associated equipment is offline, the throughput of that equipment is essentially halted until the repair or replacement is complete. Therefore, the amount of product produced with the assistance of this equipment is also essentially halted during this timeframe.

Thus, a need exists in the art for a means of reducing the time that equipment associated with a cutting roll assembly is offline. It is also desirable to provide a cutting roll assembly that results in more effective blade repair or replacement. It is also desirable to provide a cutting roll assembly that incorporates improved alignment of the cutting roll components.

SUMMARY OF THE INVENTION

It is thus an object of one aspect of the present invention to reduce downtime of a cutting roll assembly by providing a removable cartridge carrying the blades.

It is an object of another aspect of the present invention to provide for the efficient repair of work blades in the cartridge of the cutting assembly.

It is an object of an additional aspect of the present invention to provide a simple alignment system for properly positioning the cartridge in the cutting assembly.

It is an object of yet another aspect of the present invention to provide an efficient method of repairing the blades of a cutting assembly without the need for downtime thereof.

These and other objects of the present invention, as well as the advantages thereof over existing prior-art forms, which will become apparent from the description to follow, are accomplished by the improvements hereinafter described and claimed.

In general, an apparatus for severing material from a length of material includes a base member and a cutting roll cartridge having an anvil roll and a cutter roll to sever the material. The cartridge is removably mounted on the base.

A method of providing suitable cutters to form a cutting roll assembly which has a base includes the step of positioning a cutting roll cartridge having an anvil roll and a cutter roll, which has at least one cutter, on the base. The at least one cutter is allowed to wear a predetermined amount, and then the cartridge is removed from the base. A second cartridge having an anvil roll and a cutter roll with at least one cutter in condition for effective use is then positioned on the base.

A preferred exemplary cutting apparatus is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
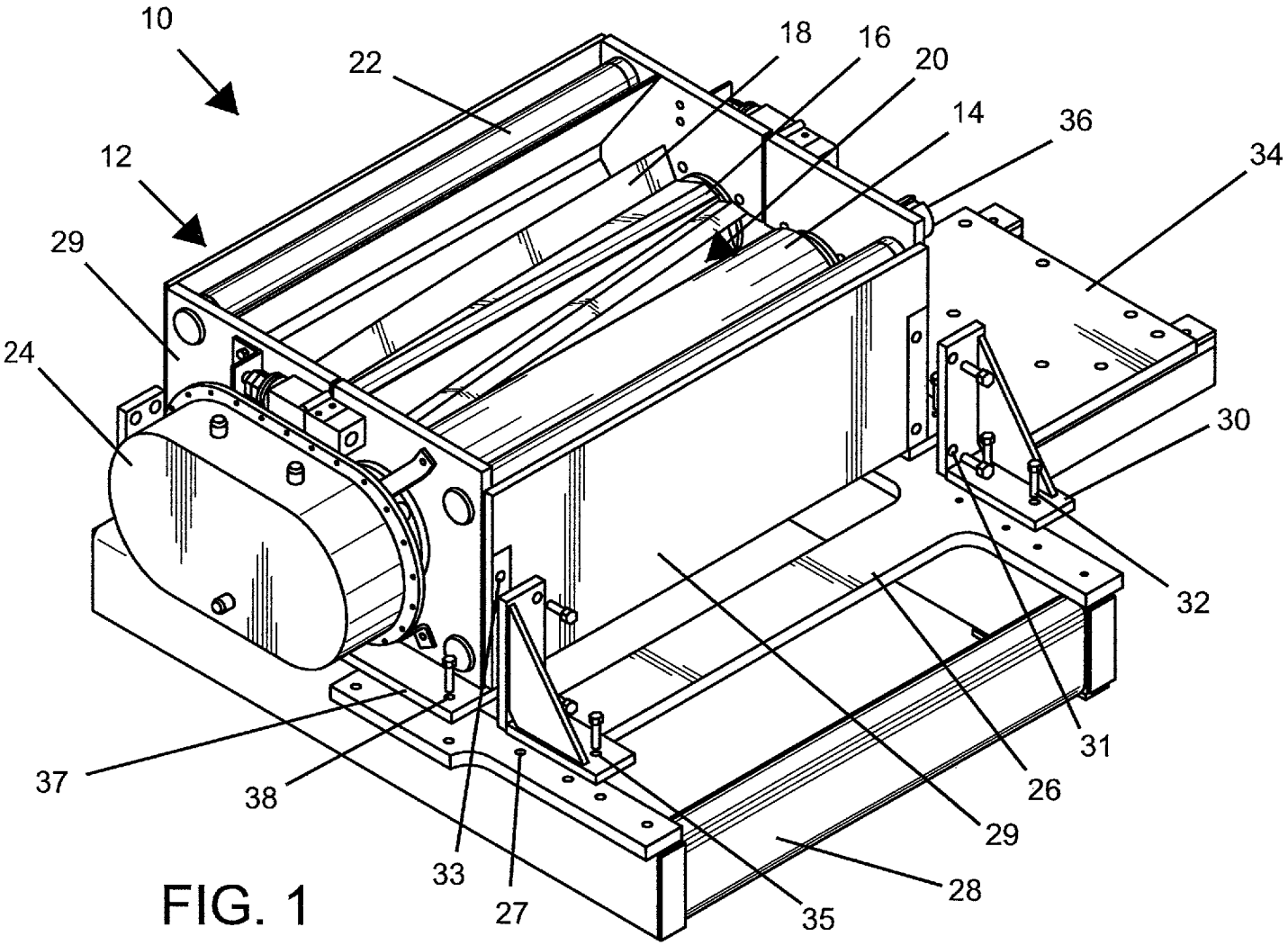
FIG. 1 is an exploded perspective view showing a cutting roll assembly including a cutting roll cartridge made in accordance with the present invention.
Figure 2:
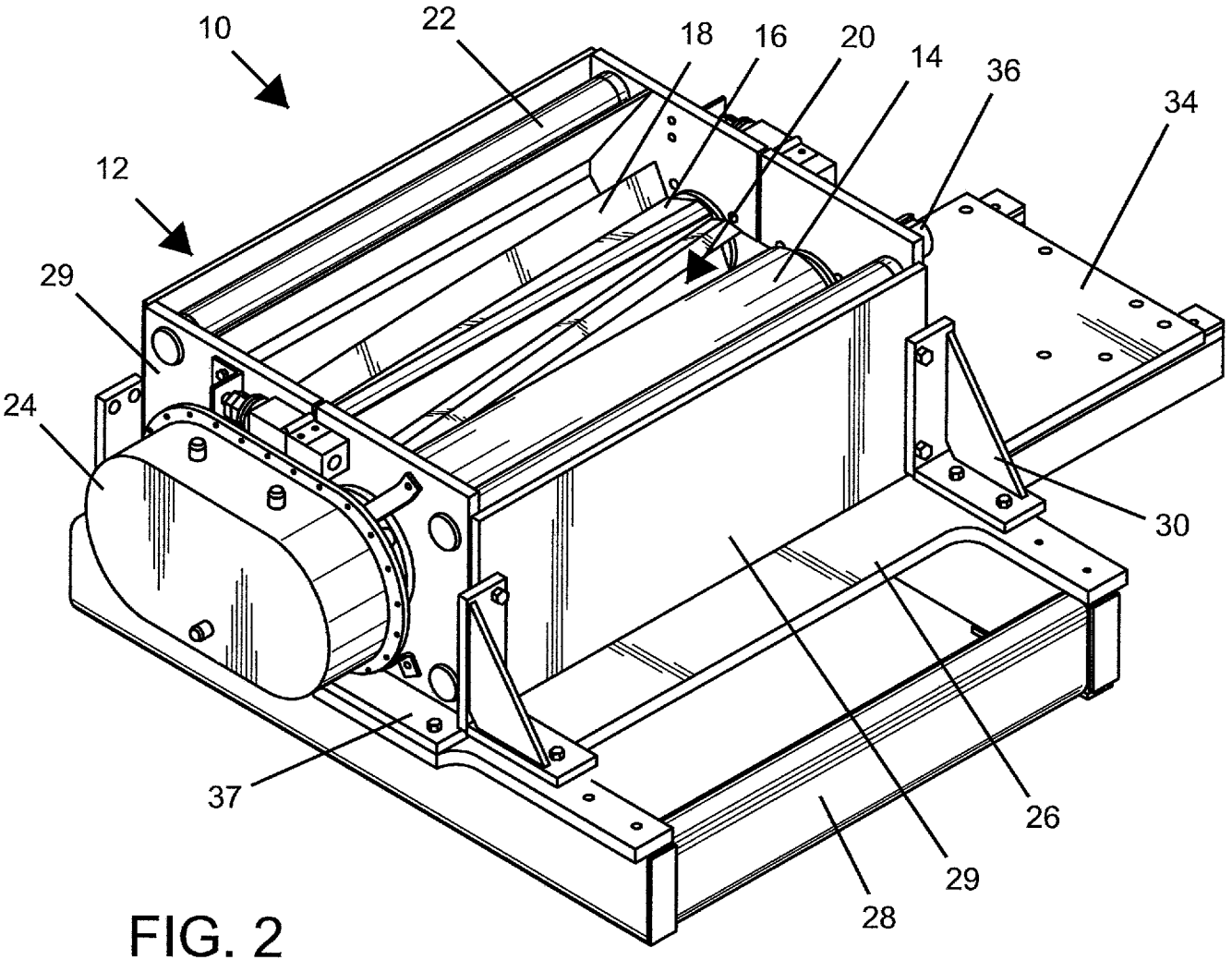
FIG. 2 is a perspective view thereof.
Figure 3:
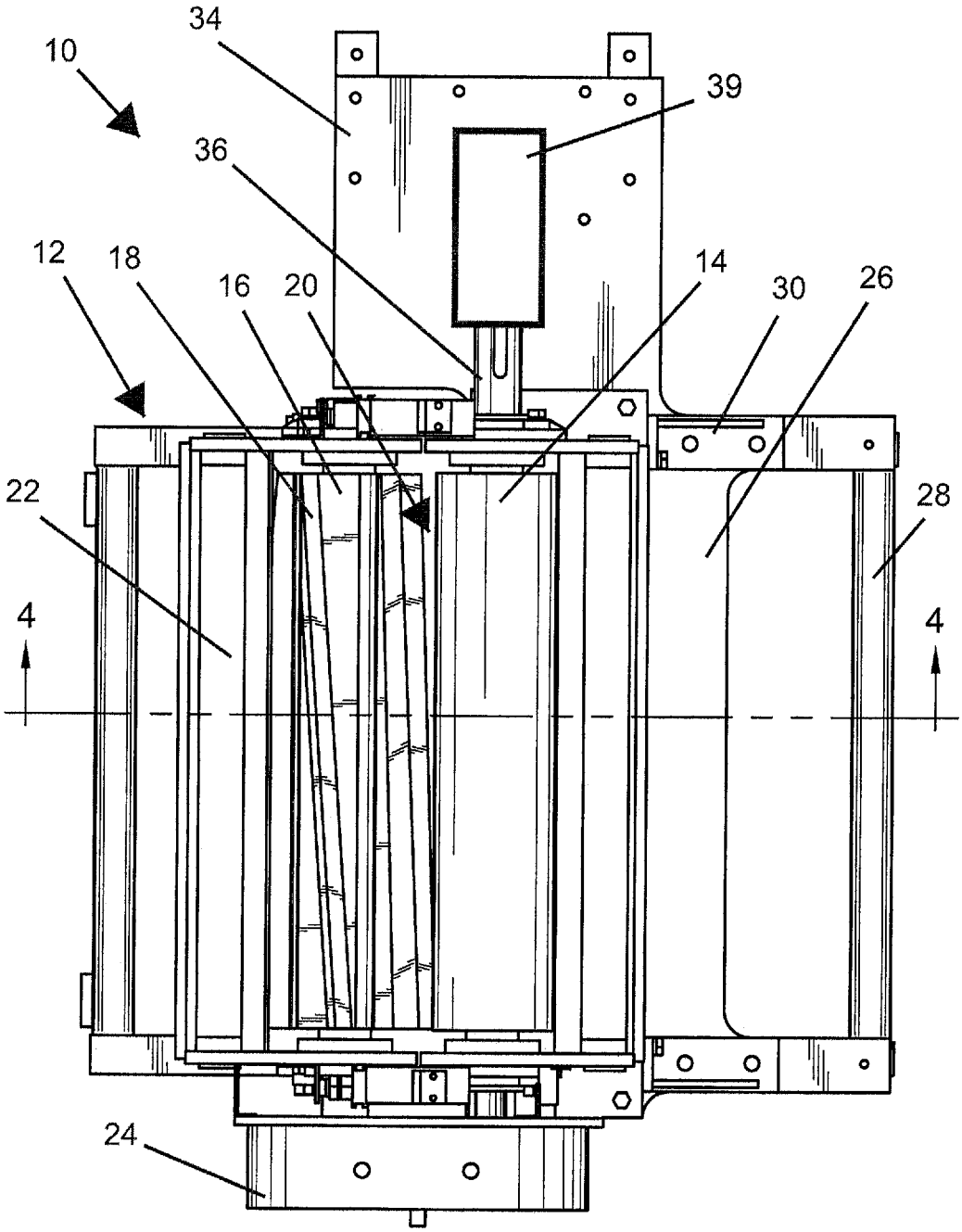
FIG. 3 is a top plan view thereof.
Figure 4:
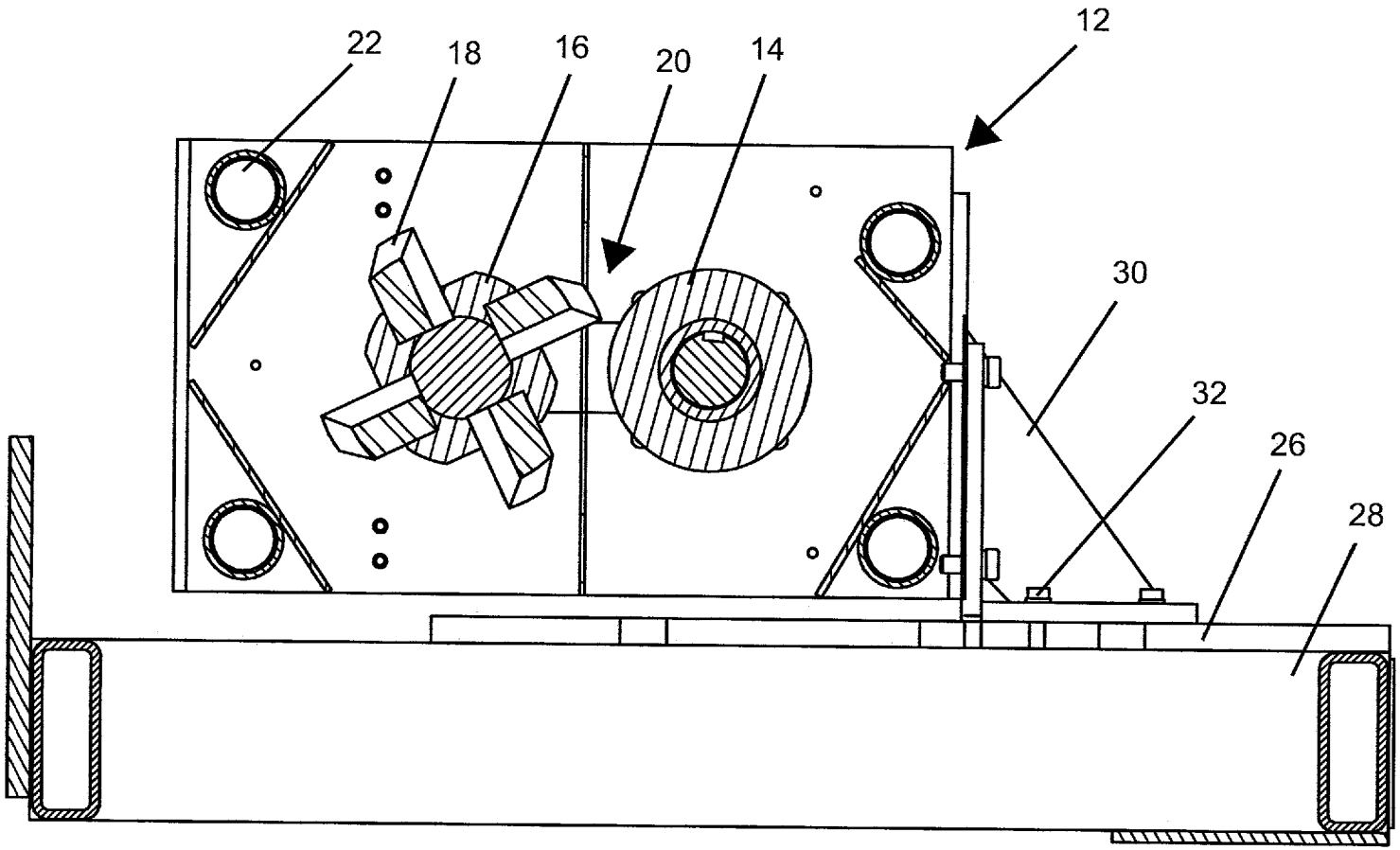
FIG. 4 is a sectional view thereof taken substantially along line 4-4 of FIG. 3.
Figure 5:
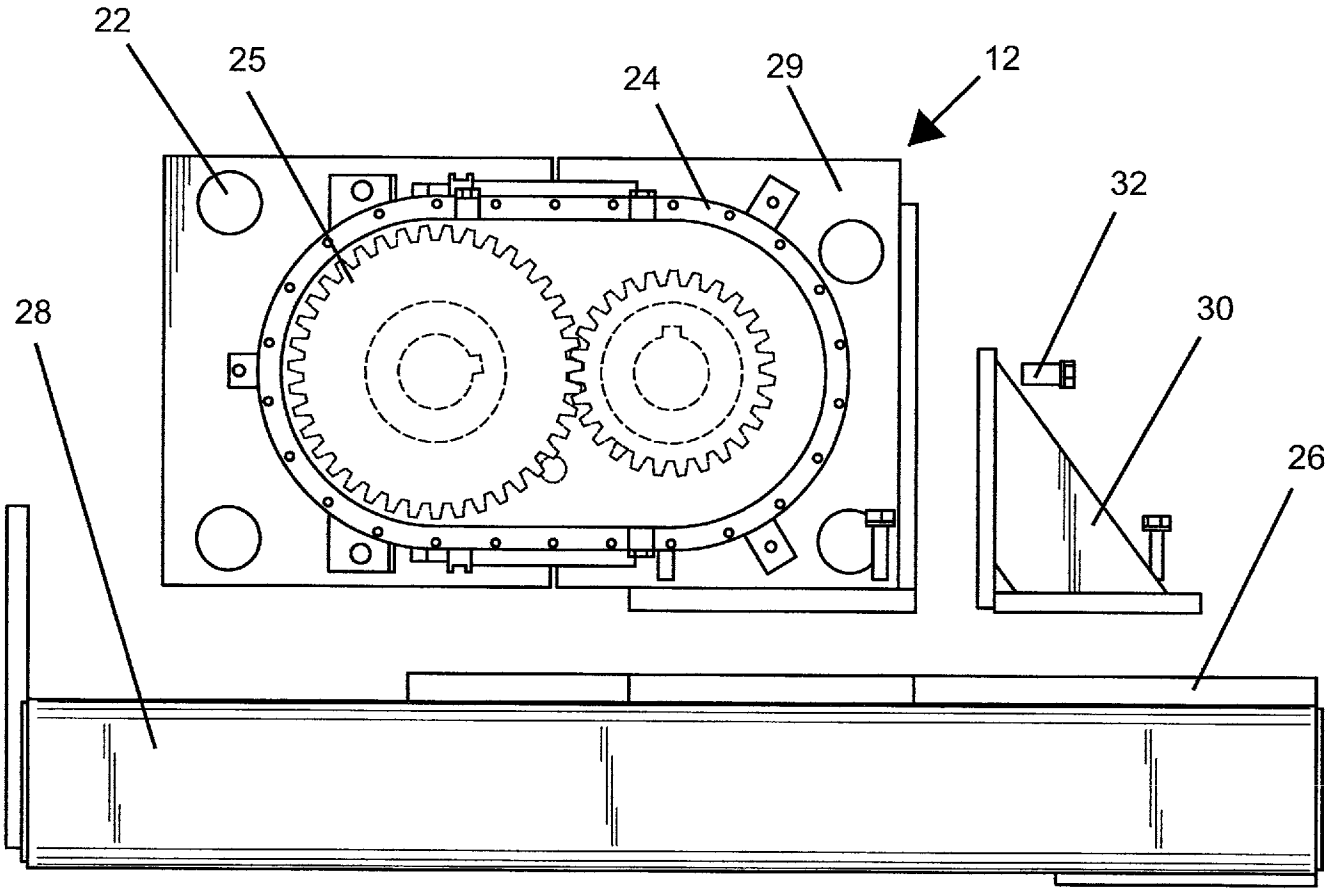
FIG. 5 is an exploded left side elevational view thereof.

A cutting roll assembly for severing lengths of material into shorter, predetermined lengths is generally indicated by the numeral 10 and includes a cutting roll cartridge, generally indicated by the numeral 12, a base 26, a frame 28, and a plate 34.

Figure 6:
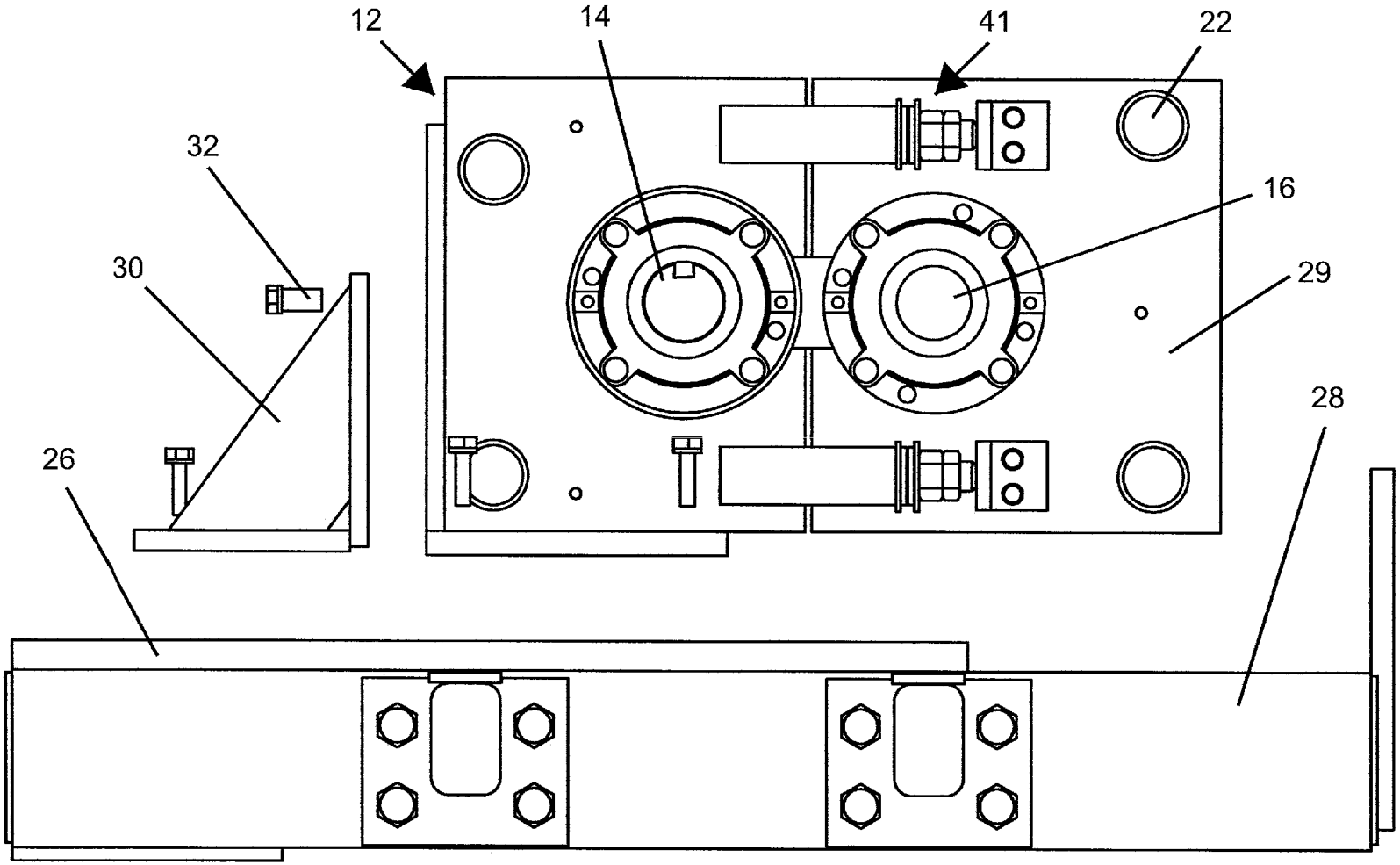
FIG. 6 is an exploded right side elevational view thereof.
Figure 7:
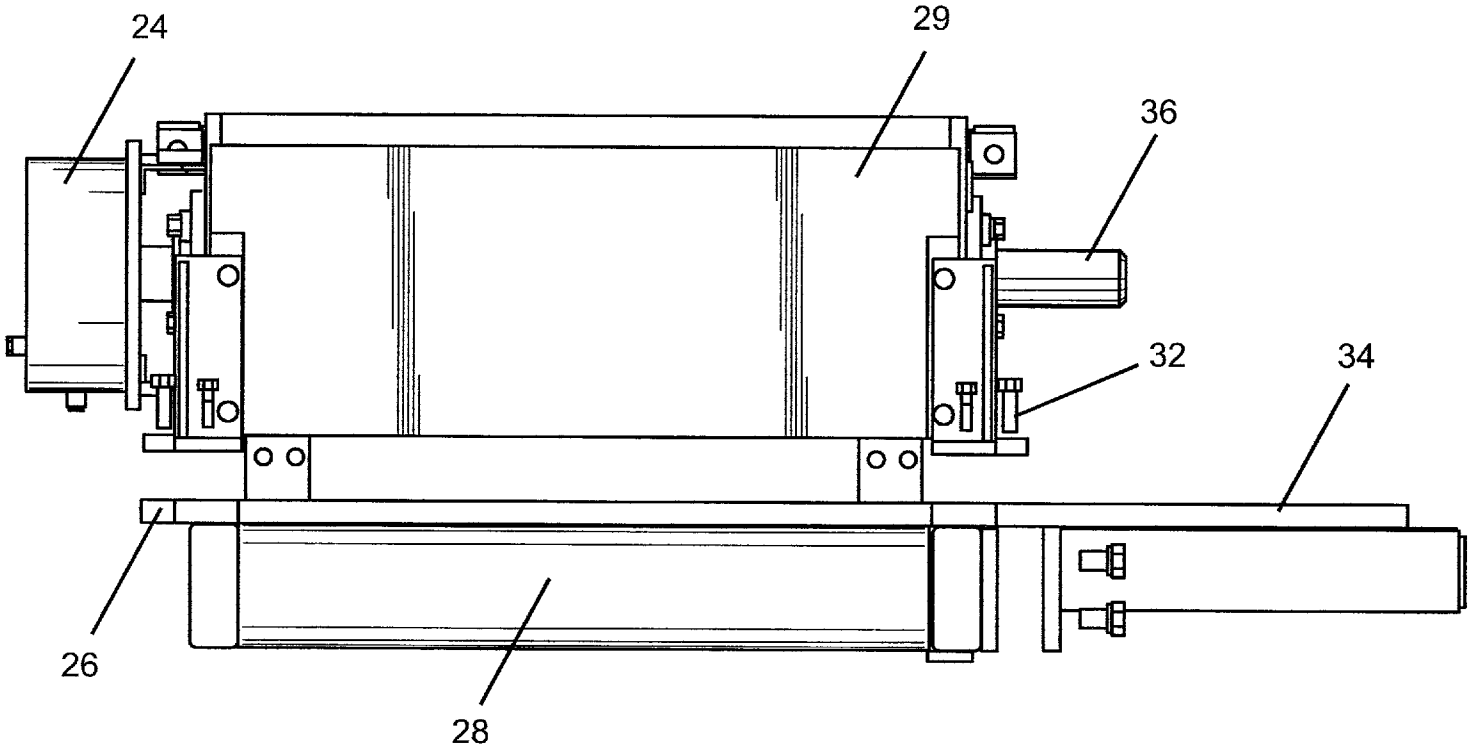
FIG. 7 is a front elevational view thereof.
Figure 8:
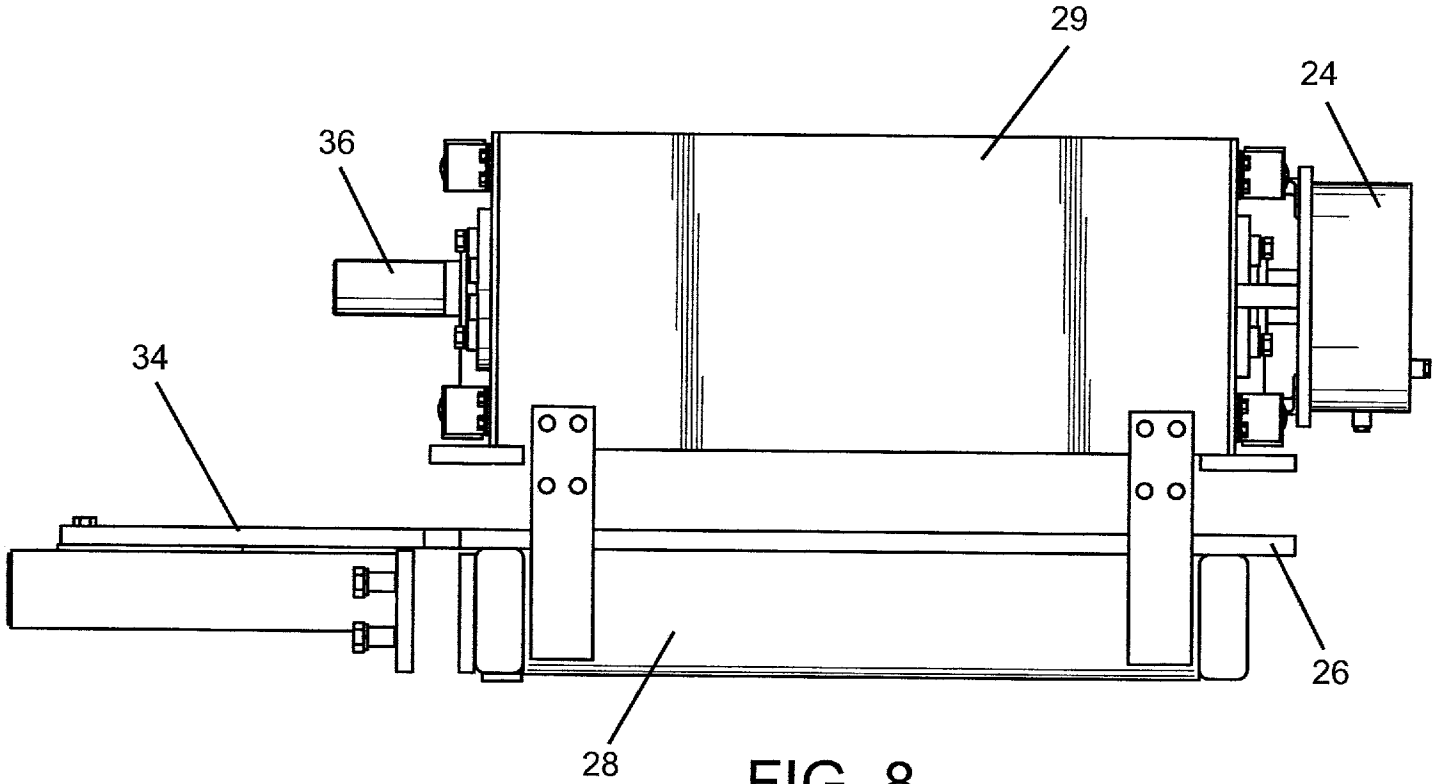
FIG. 8 is a rear elevational view thereof.

Cutting roll cartridge 12 includes an anvil roll 14 and a cutter roll 16 having cutter blades 18. Anvil roll 14 and cutter roll 16 are rotatably mounted in cutting roll cartridge 12 and are oppositely rotating such that anvil roll 14 serves as an anvil against which the material is cut by cutter blades 18. Four cutter blades 18 are illustrated herein, but one skilled in the art will appreciate that any useful number of cutter blades could be used. The material to be cut into shorter lengths is fed in between anvil roll 14 and cutter roll 16 at a feed location, generally indicated by the numeral 20. Means for controlling the spacing and amount of movement upon a cutting action are generally indicated by the numeral 41 (FIG. 6). Such means include the use of shims and are further disclosed in the '628 patent incorporated herein.

Cutting roll cartridge 12 includes sidewalls 29 carrying anvil roll 14 and cutter roll 16. Sidewalls 29 also carry support bars 22, where both sidewalls 29 and support bars 22 provide support for holding cutting roll cartridge 12 together.

Cutting roll cartridge also includes gear casing 24 housing gears 25 therein. Gears 25 allow for the opposite rotation of anvil roll 14 and the cutter roll 16. Gear casing 24 can be attached to one of the sidewalls 29. A direct drive gear system is shown, but one skilled in the art will appreciate that other useful gear systems can be used.

As shown in FIG. 1, cutting roll cartridge 12 is removable as an entire unit from base 26. Base 26 is attached on top of frame 28 and both base 26 and frame 28 can provide support for cutting roll assembly and essentially fixedly locate cutting roll cartridge 12 when cutting roll cartridge 12 is attached thereto. Base 26 and frame 28 remain in their essentially fixed location when cutting roll cartridge 12 is removed, such as when it is necessary to repair at least one cutter blade 18 of cutting roll cartridge 12. In one embodiment, base 26 and frame 28 may be constructed together as one component. In another embodiment, base 26 is fixed in a position on the associated production equipment without the need for a frame. Cutting roll cartridge 12 can include alignment tabs 37 having alignment holes 38 therein. For installing a new or serviced cutting roll cartridge 12 to base 26 and frame 28, cartridge alignment holes 38 are aligned with the associated alignment holes 27 of base 26 and frame 28. Securing means, such as alignment bolts 32, are then used to essentially fixedly secure cutting roll cartridge 12 to base 26 and frame 28. Bolts 32 can be secured in place by any component known in the art, such as an appropriately sized and tightened nut.

For further securement of a new or serviced cutting roll cartridge 12, alignment brackets 30 are utilized to secure cutting roll cartridge 12 in the proper position on base 26 and frame 28. Alignment brackets 30 have alignment holes 31 and alignment holes 35 therein. Alignment holes 35 of alignment brackets 30 are aligned with associated alignment holes 27 of base 26 and frame 28. Alignment holes 31 of the alignment brackets 30 are aligned with associated alignment holes 33 of sidewall 29 of cutting roll cartridge 12. Once all associated alignment holes are aligned, securing means, such as alignment bolts 32, are then inserted into the alignment holes to essentially fixedly secure cutting roll cartridge 12 in the associated location with respect to the fixed base 26 and frame 28. Although a certain total number of alignment holes and bolts are shown, one skilled in the art will recognize that any number can be used. It is envisioned that a minimum of one alignment hole can be used for each component, although more than one is preferred for improved securement of the components.

Figure 9:
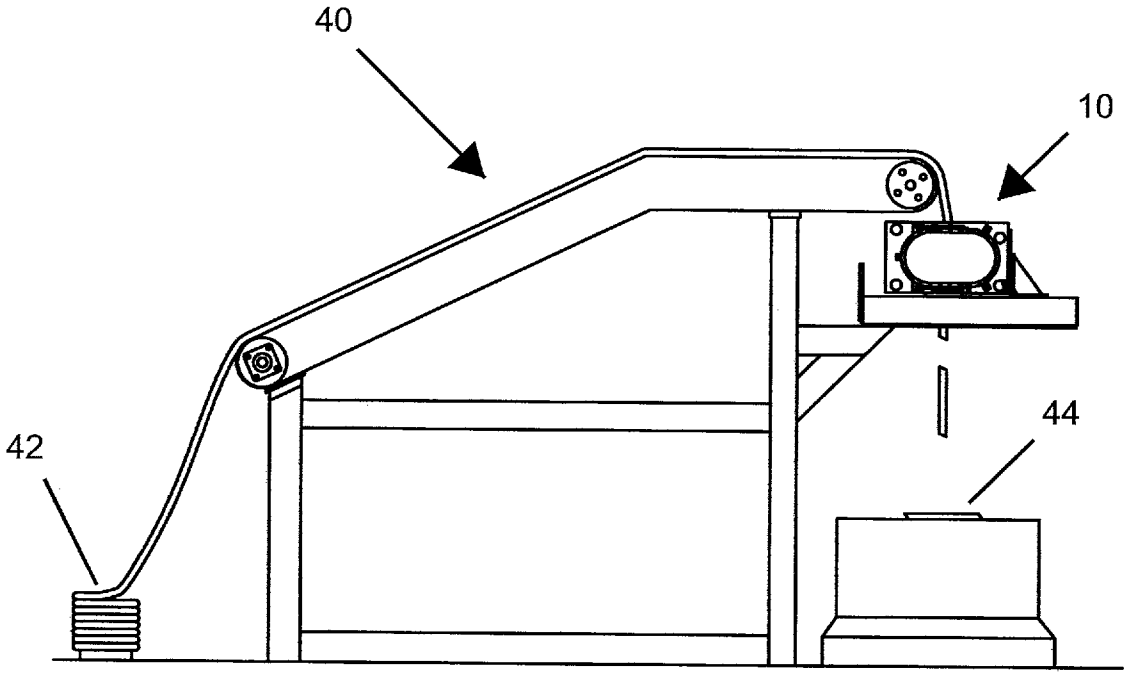
FIG. 9 is a schematic view showing a cutting roll assembly of the present invention in use with a conveyor assembly.

As discussed above, base 26 and frame 28 are fixed or essentially fixed in a location, such as part of a production machine, generally indicated by the numeral 40 (FIG. 9). The cutting roll cartridge 12 is then removable from base 26 and frame 28. Regarding the structure of base 26 and frame 28, base 26 is shown in the figures as being generally I-shaped and frame 28 is shown as being generally rectangular. One skilled in the art will appreciate that base 26 and frame 28 can be shaped to meet the needs of a user, so long as base 26 and frame 28 are capable of supporting cutting roll cartridge 12. One skilled in the art will also appreciate that embodiments of the present invention utilize cutting roll cartridge 12 without base 26 and frame 28, or with another attachment means that is known in the art or that will become known in the art.

Cutting roll assembly 10 includes motor plate 34 for carrying a motor 39 that drives a drive shaft 36. Motor plate 34 is attached, or attachable, to frame 28. Motor plate 34 can also be attached, or attachable, to base 26. Motor 39 causes drive shaft 36 to rotate, such that the rotation of drive shaft 36 leads to the rotation of anvil roll 14. The rotation of the anvil roll 14 causes the cutter roll 16 to rotate by means of gears 25 located within gear casing 24. In one or more embodiments, each of anvil roll 14 and cutter roll 16 have one associated gear. But, gear casing 24 can contain any gear configuration as known to one skilled in the art, including having an oil bath for the gears 25 contained therein.

While cutting roll assembly 10 is in operation of cutting a length of material 42 into shorter lengths 44, cutter blades 18 will generally wear at a rate according to the usage rate. That is, the more material that is cut by cutting roll assembly 10, the more wear will generally be experienced by cutter blades 18. Once cutter blades 18 of cutting roll 16 reach a certain level of wear, cutter blades 18 must be either repaired or replaced. To repair or replace cutter blades 18, or to both repair certain blades and replace other blades, the cutting roll cartridge 12 is removed from base 26 and frame 28. Then, a new or repaired cutting roll cartridge 12 is placed in the former cartridge's place and the cutter blades of the former cartridge are repaired or replaced.

To remove cutting roll cartridge 12 from base 26 and frame 28, all securing means, such as alignment bolts 32, are removed and a drive coupling (not shown) is disconnected so that drive shaft 36 can be detached from motor 39. Some of the figures show the cutting roll cartridge 12 being detached from base 26. Previously known actions for disassembling a cutting roll assembly involve the need to move a drive wheel and disassemble the cutting roll assembly in order to access the cutter blades for repair or replacement.

As discussed above, based on the modular design of the present invention, a cutting roll cartridge 12 that has been removed from a cutting roll 10 can then be repaired offline to be put into a condition for re-insertion into the cutting roll assembly 10. As such, one or more embodiments of the present invention include a method of repairing cutters in a cutting roll assembly. A method of repairing cutters in a cutting roll assembly can include the steps of providing a cutting roll assembly having a cutting roll cartridge therein, allowing cutters of cutting roll cartridge to wear a predetermined amount, removing the cutting roll cartridge as a whole from the cutting roll assembly, providing a second cutting roll cartridge assembly having cutters that are in a condition for effective use in a cutting process, and repairing or replacing the cutters in the first cutting roll cartridge. One or more of these steps can be repeated in order to continuously supply a cutting roll assembly with a cutting roll cartridge having cutters in a condition for effective use in a cutting process.

Cutting roll cartridge 12 can also include optional features as desired by the user. Such features include the ability to adjust the distance between the cutter blades 18 and the anvil roll 14 and the ability to measure the spacing between the anvil roll 14 and cutter roll 16, such as is described in the '628 patent incorporated herein.

Advantageously, methods, cutting roll cartridges, and cutting roll assemblies just described allow cutting roll blades to be replaced more efficiently. In particular, the modular design allows an old cutting roll cartridge containing worn or damaged blades to be removed from a cutting roll assembly such that a cutting roll cartridge having new or repaired blades can be installed in the old cartridge's place. The old cutting roll cartridge can then be repaired without affecting the production of the associated equipment. The old cutting roll cartridge is repaired such that it becomes suitable for re-use in a cutting roll assembly.

This modular approach results in a significant decrease in time that the equipment associated with a cutting roll assembly is required to be offline. When the associated equipment is offline, the normal product production of this equipment is halted or essentially halted. Reducing the offline time caused by repairing or replacing the blades of a cutting roll assembly therefore results in increased production of the associated equipment. This increased production results in a substantial economic benefit. In one or more embodiments, the offline time as a result of repairing or replacing blades is reduced from a timeframe of approximately six to eight hours to a timeframe of approximately thirty minutes. Again, this time savings results in increased production time.

Thus, the cutting roll cartridges and cutting roll assemblies described herein accomplish the objects of the present invention and otherwise substantially improve the art.

What is claimed is:

1. A method of improving efficiency of cutting material by improving the replacing or repairing of blades in a cutting roll assembly, the method comprising steps of providing a first cutting roll cartridge having a sidewall perimeter, the sidewall perimeter being formed by a first independent separated perimeter portion and a second independent separated perimeter portion, the first independent separated perimeter portion carrying an anvil roll and further carrying an alignment tab extending therefrom, the alignment tab having a tab alignment hole, and the second independent separated perimeter portion spaced apart from the first independent separated perimeter portion and carrying a cutter roll having at least one cutter blade, and means for controlling the spacing and amount of movement between the first independent separated perimeter portion with the second independent separated perimeter portion upon a cutting action, providing an alignment bracket having a bracket alignment hole, providing a base having a first base alignment hole and a second base alignment hole, aligning the tab alignment hole with the first base alignment hole, aligning the bracket alignment hole with the second base alignment hole, positioning the first cutting roll cartridge on the base, wherein the step of positioning the first cutting roll cartridge includes directly affixing the first independent separated perimeter portion with the base by way of the alignment tab, and wherein the step of positioning the first cutting roll cartridge does not include directly affixing the second independent separated perimeter portion with the base, providing a material having an original length to the first cutting roll cartridge, cutting, with the at least one cutter blade of the first cutting roll cartridge, the material into a plurality of pieces of the material each having a shorter length than the original length of the material, thereby wearing the at least one cutter blade of the first cutting roll cartridge by a predetermined amount to thereby become an at least one worn cutter blade of the first cutting roll cartridge, removing, after the step of cutting, the first cutting roll cartridge from the base, positioning a second cutting roll cartridge having an anvil roll and a cutter roll with at least one cutter blade in a condition for effective use on the base, providing an additional material having an original length to the second cutting roll cartridge, additionally cutting, with the at least one cutter blade of the second cutting roll cartridge, the additional material into a plurality of pieces of the additional material each having a shorter length than the original length of the additional material, thereby wearing the at least one cutter blade of the second cutting roll cartridge by a predetermined amount to thereby become an at least one worn cutter blade of the second cutting roll cartridge, repairing or replacing the at least one worn cutter blade in the first cutting roll cartridge to thereby form a first cutting roll cartridge in a condition for effective use, removing, after the step of repairing or replacing, the second cutting roll cartridge from the base, and additionally repairing or replacing the at least one worn cutter blade in the second cutting roll cartridge to thereby form a second cutting roll cartridge in a condition for effective use.

2. The method of claim 1, wherein the step of cutting with the first cutting roll cartridge includes a motor coupled with a drive shaft acting on the anvil roll of the first cutting roll cartridge for causing rotation thereof, wherein the step of removing the first cutting roll cartridge includes detaching the drive shaft from the motor.

* * * * *